US007802439B2

(12) United States Patent
Valiya-Naduvath et al.

(10) Patent No.: US 7,802,439 B2
(45) Date of Patent: Sep. 28, 2010

(54) MULTICHANNEL EVAPORATOR WITH FLOW MIXING MULTICHANNEL TUBES

(75) Inventors: Mahesh Valiya-Naduvath, Lutherville, MS (US); Jeffrey Lee Tucker, Wichita, KS (US); John T. Knight, Wichita, KS (US)

(73) Assignee: Johnson Controls Technology Company, Holland, MI (US)

( * ) Notice: Subject to any disclaimer, the term of this patent is extended or adjusted under 35 U.S.C. 154(b) by 256 days.

(21) Appl. No.: 12/040,588

(22) Filed: Feb. 29, 2008

(65) Prior Publication Data

US 2008/0141686 A1 Jun. 19, 2008

Related U.S. Application Data

(63) Continuation of application No. PCT/US2007/085247, filed on Nov. 20, 2007.

(60) Provisional application No. 60/882,033, filed on Dec. 27, 2006, provisional application No. 60/867,043, filed on Nov. 22, 2006.

(51) Int. Cl.
*F25B 5/00* (2006.01)

(52) U.S. Cl. ..... 62/117; 62/515

(58) Field of Classification Search ..... 62/503, 62/511, 509, 515, 527, 498, 474, 117; 165/132, 165/153, 174, 44, 175, 121
See application file for complete search history.

(56) References Cited

U.S. PATENT DOCUMENTS

| | | | |
|---|---|---|---|
| 3,229,722 | A | 1/1966 | Kritzer |
| 3,603,384 | A | 9/1971 | Huggins et al. |
| 3,636,982 | A | 1/1972 | Drake |
| 3,871,407 | A | 3/1975 | Bykov et al. |
| 4,031,602 | A | 6/1977 | Cunningham et al. |
| 4,190,105 | A | 2/1980 | Dankowski |
| 4,370,868 | A | 2/1983 | Kim |
| 4,766,953 | A | 8/1988 | Grieb et al. |
| 5,168,925 | A | 12/1992 | Suzumura |
| 5,186,248 | A | 2/1993 | Halstead |
| 5,251,692 | A | 10/1993 | Haussmann |
| 5,327,959 | A | 7/1994 | Saperstein |
| 5,372,188 | A | 12/1994 | Dudley |

(Continued)

FOREIGN PATENT DOCUMENTS

| | | |
|---|---|---|
| DE | 19740114 | 3/1999 |

(Continued)

OTHER PUBLICATIONS

U.S. Appl. No. 12/040,501, filed Feb. 29, 2008, Tucker et al.

(Continued)

*Primary Examiner*—Mohammad M Ali
(74) *Attorney, Agent, or Firm*—Fletcher Yoder

(57) ABSTRACT

Heating, ventilation, air conditioning, and refrigeration (HVAC&R) systems, heat exchangers, and multichannel tubes are provided which include internal configurations designed to promote mixing. The multichannel tubes include interior walls which form flow channels. The interior walls are interrupted at locations along the multichannel tube in order to provide open spaces between the flow channels where mixing may occur. The mixing that occurs promotes a more homogenous distribution of refrigerant within the multichannel tubes.

21 Claims, 4 Drawing Sheets

U.S. PATENT DOCUMENTS

| | | | | |
|---|---|---|---|---|
| 5,448,899 | A | 9/1995 | Ohara | |
| 5,479,784 | A | 1/1996 | Dobmeier | |
| 5,586,598 | A | 12/1996 | Tanaka et al. | |
| 5,638,897 | A * | 6/1997 | Hirano et al. | 165/153 |
| 5,797,184 | A | 8/1998 | Tanaka et al. | |
| 5,806,646 | A * | 9/1998 | Grosspietsch et al. | 192/70.252 |
| 5,826,646 | A | 10/1998 | Bae | |
| 5,836,382 | A | 11/1998 | Dingle | |
| 5,901,782 | A | 5/1999 | Voss | |
| 5,901,785 | A | 5/1999 | Chiba | |
| 5,910,167 | A | 6/1999 | Reinke | |
| 5,931,226 | A * | 8/1999 | Hirano et al. | 165/170 |
| 5,934,367 | A | 8/1999 | Shimmura | |
| 5,941,303 | A | 8/1999 | Gowan et al. | |
| 5,967,228 | A | 10/1999 | Bergman | |
| 6,032,728 | A * | 3/2000 | Ross et al. | 165/153 |
| 6,148,635 | A | 11/2000 | Beebe | |
| 6,155,075 | A | 12/2000 | Hanson | |
| 6,199,401 | B1 | 3/2001 | Haussmann | |
| 6,449,979 | B1 | 9/2002 | Nagasawa | |
| 6,502,413 | B2 | 1/2003 | Repice | |
| 6,513,576 | B1 * | 2/2003 | Le Guen et al. | 165/44 |
| 6,513,582 | B2 | 2/2003 | Krupa et al. | |
| 6,615,488 | B2 | 9/2003 | Anders et al. | |
| 6,688,137 | B1 | 2/2004 | Gupte | |
| 6,814,136 | B2 | 11/2004 | Yi | |
| 6,827,128 | B2 | 12/2004 | Philpott | |
| 6,868,696 | B2 | 3/2005 | Ikuta | |
| 6,886,349 | B1 | 5/2005 | Curicuta | |
| 6,892,802 | B2 | 5/2005 | Kelly | |
| 6,904,966 | B2 | 6/2005 | Philpott | |
| 6,912,864 | B2 | 7/2005 | Roche | |
| 6,932,153 | B2 | 8/2005 | Ko | |
| 6,964,296 | B2 | 11/2005 | Memory | |
| 6,988,538 | B2 | 1/2006 | Merkys | |
| 7,000,415 | B2 | 2/2006 | Daddis | |
| 7,003,971 | B2 | 2/2006 | Kester | |
| 7,021,370 | B2 | 4/2006 | Papapanu | |
| 7,028,483 | B2 | 4/2006 | Mansour | |
| 7,044,200 | B2 | 5/2006 | Gupte | |
| 7,066,243 | B2 | 6/2006 | Horiuchi | |
| 7,073,570 | B2 * | 7/2006 | Yu et al. | 165/140 |
| 7,080,526 | B2 | 7/2006 | Papapanu | |
| 7,080,683 | B2 | 7/2006 | Bhatti et al. | |
| 7,107,787 | B2 | 9/2006 | Inaba | |
| 7,143,605 | B2 | 12/2006 | Rohrer | |
| 7,163,052 | B2 | 1/2007 | Taras | |
| 7,201,015 | B2 | 4/2007 | Feldman | |
| 7,219,511 | B2 | 5/2007 | Inaba | |
| 7,222,501 | B2 | 5/2007 | Cho | |
| 7,296,620 | B2 * | 11/2007 | Bugler et al. | 165/150 |
| 7,337,831 | B2 * | 3/2008 | Torii | 165/109.1 |
| 2004/0134226 | A1 | 7/2004 | Kraay | |
| 2004/0261983 | A1 | 12/2004 | Hu | |
| 2005/0056049 | A1 | 3/2005 | Sanada | |
| 2005/0217831 | A1 | 10/2005 | Manaka | |
| 2005/0241816 | A1 | 11/2005 | Shabtay et al. | |
| 2005/0269069 | A1 | 12/2005 | Hancock | |
| 2006/0102332 | A1 | 5/2006 | Taras | |
| 2006/0130517 | A1 | 6/2006 | Merkys | |
| 2007/0039724 | A1 | 2/2007 | Trumbower | |
| 2008/0092587 | A1 | 4/2008 | Gorbounov et al. | |
| 2008/0093062 | A1 | 4/2008 | Gorbounov et al. | |

FOREIGN PATENT DOCUMENTS

| | | |
|---|---|---|
| DE | 10014099 | 6/1999 |
| EP | 0219974 | 4/1987 |
| EP | 0583851 | 2/1994 |
| EP | 0762070 | 3/1997 |
| EP | 0781610 | 7/1997 |
| EP | 0845646 | 6/1998 |
| EP | 1426714 | 6/2004 |
| GB | 2406164 | 3/2005 |
| JP | 56130595 | 10/1981 |
| JP | 58045495 | 3/1983 |
| JP | 04069228 | 3/1992 |
| JP | 04186070 | 6/1992 |
| JP | 07190661 | 7/1995 |
| JP | 1047879 | 2/1998 |
| JP | 10062092 | 3/1998 |
| JP | 11083371 | 3/1999 |
| JP | 04069258 | 3/2004 |
| WO | WO02/103270 | 12/2002 |
| WO | WO2006/083426 | 8/2006 |
| WO | WO2006/083435 | 8/2006 |
| WO | WO2006/083441 | 8/2006 |
| WO | WO2006/083442 | 8/2006 |
| WO | WO2006/083443 | 8/2006 |
| WO | WO2006/083445 | 8/2006 |
| WO | WO2006/083446 | 8/2006 |
| WO | WO2006/083447 | 8/2006 |
| WO | WO2006/083448 | 8/2006 |
| WO | WO2006/083449 | 8/2006 |
| WO | WO2006/083450 | 8/2006 |
| WO | WO2006/083451 | 8/2006 |
| WO | WO2006/083484 | 8/2006 |
| WO | WO 2006083445 | 8/2006 |

OTHER PUBLICATIONS

U.S. Appl. No. 12/040,559, filed Feb. 29, 2008, Knight et al.
U.S. Appl. No. 12/040,612, filed Feb. 29, 2008, Yanik et al.
U.S. Appl. No. 12/040,661, filed Feb. 29, 2008, Yanik et al.
U.S. Appl. No. 12/040,697, filed Feb. 29, 2008, Yanik et al.
U.S. Appl. No. 12/040,724, filed Feb. 29, 2008, Obosu et al.
U.S. Appl. No. 12/040,743, filed Feb. 29, 2008, Breiding et al.
U.S. Appl. No. 12/040,764, filed Feb. 29, 2008, Knight.

* cited by examiner

FIG. 1
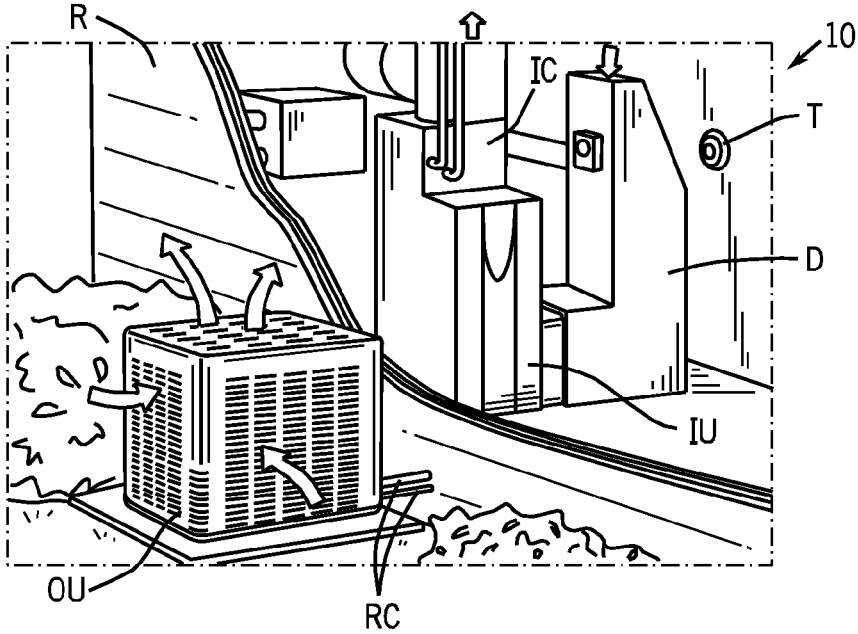
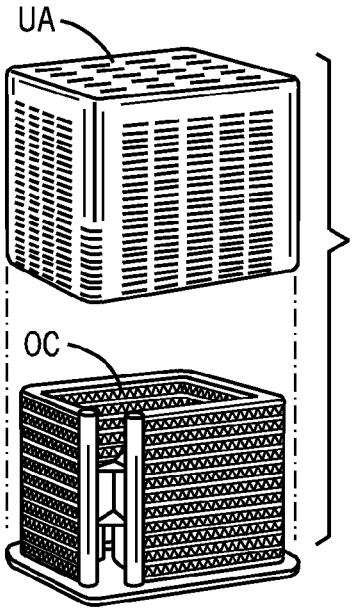
FIG. 2
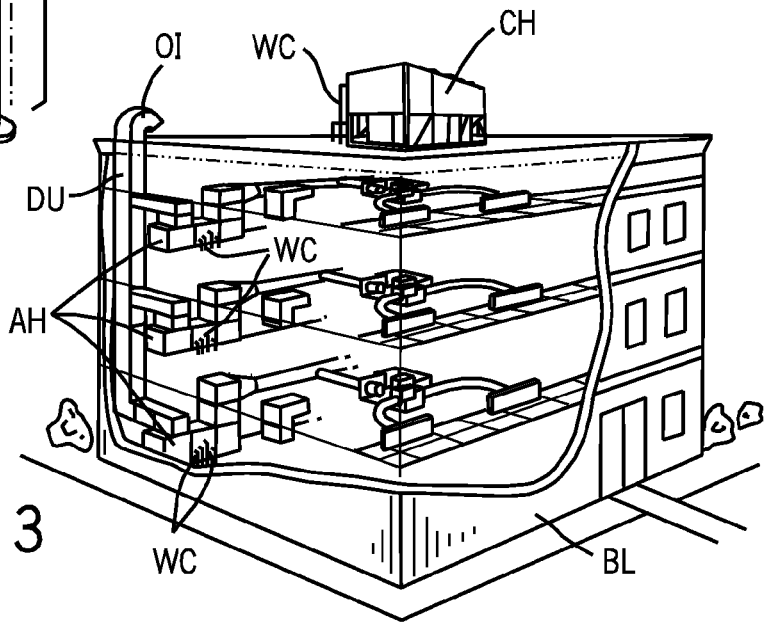
FIG. 3

FIG. 6
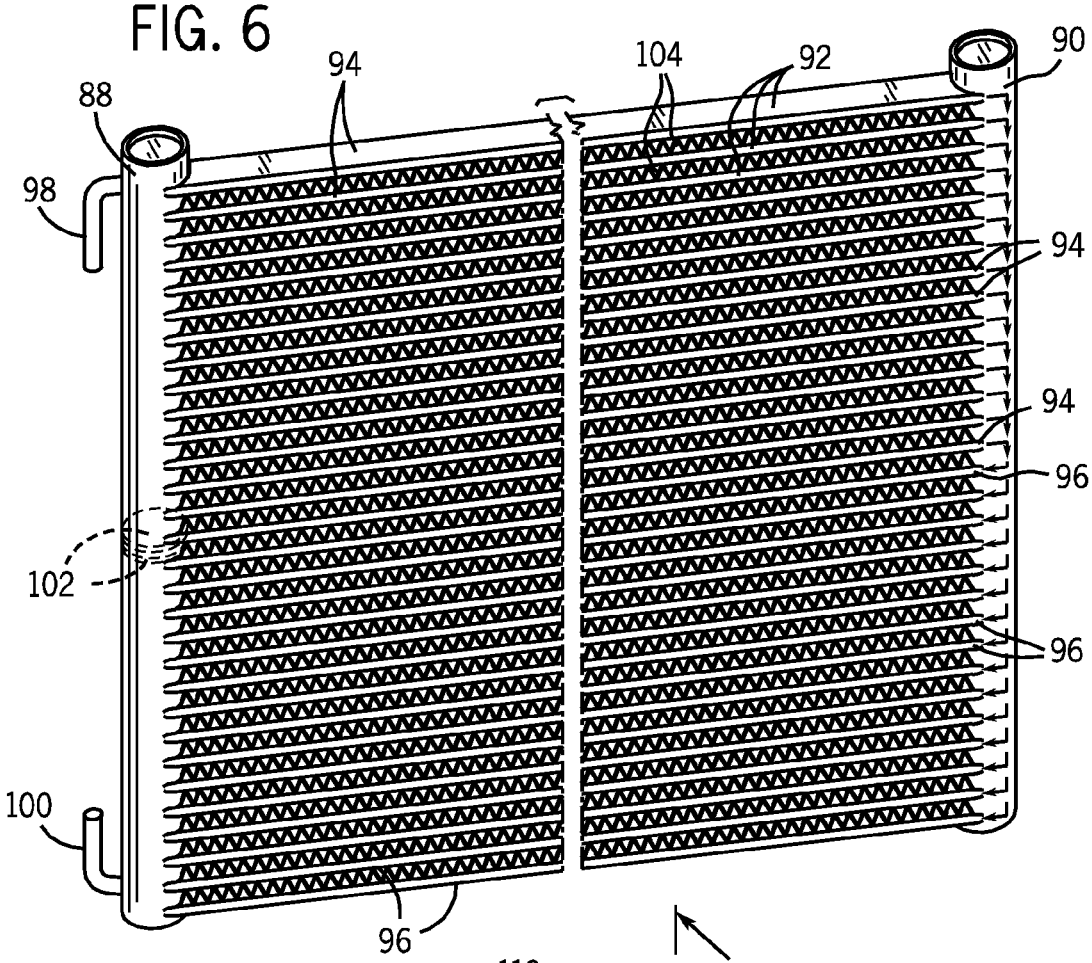
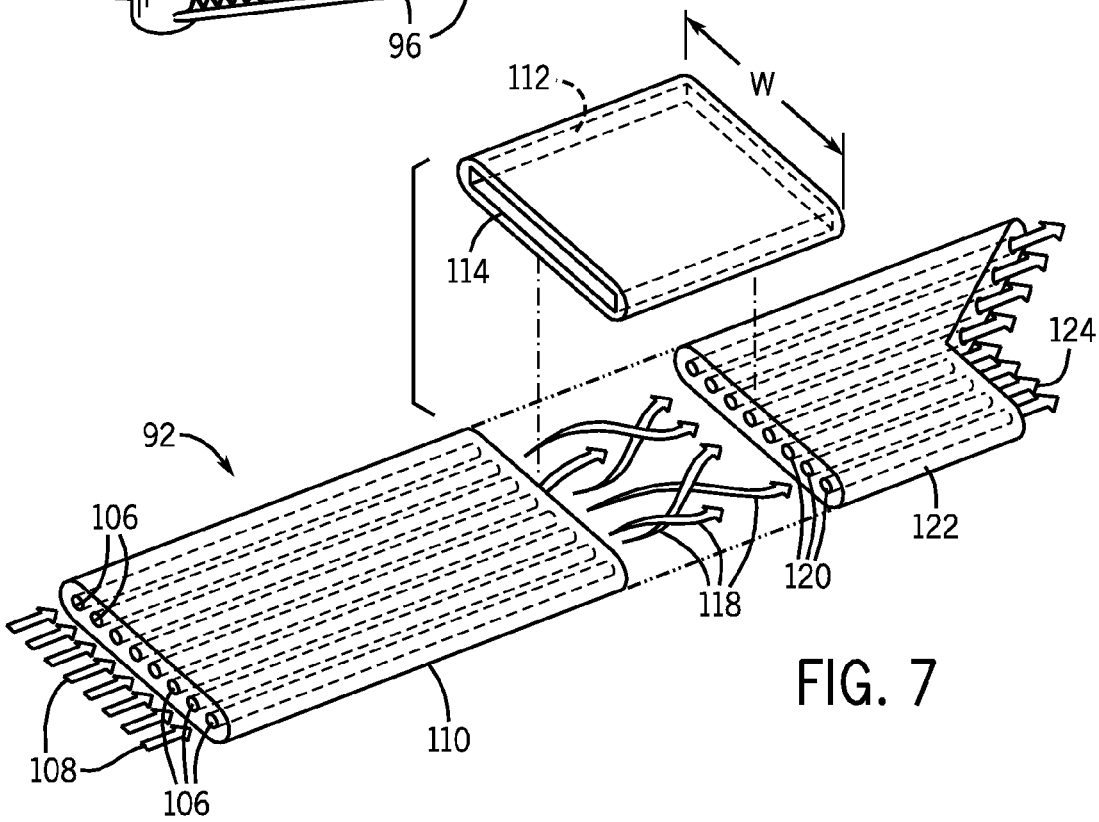
FIG. 7

MULTICHANNEL EVAPORATOR WITH FLOW MIXING MULTICHANNEL TUBES

CROSS REFERENCE TO RELATED APPLICATIONS

This application claims priority from and the benefit of U.S. Provisional Application Ser. No. 60/867,043, entitled MICROCHANNEL HEAT EXCHANGER APPLICATIONS, filed Nov. 22, 2006, and U.S. Provisional Application Ser. No. 60/882,033, entitled MICROCHANNEL HEAT EXCHANGER APPLICATIONS, filed Dec. 27, 2006, which are hereby incorporated by reference.

BACKGROUND

The invention relates generally to multichannel evaporators with flow mixing multichannel tubes.

Heat exchangers are used in heating, ventilation, air conditioning, and refrigeration (HVAC&R) systems. Multichannel heat exchangers generally include multichannel tubes for flowing refrigerant through the heat exchanger. Each multichannel tube may contain several individual flow channels. Fins may be positioned between the tubes to facilitate heat transfer between refrigerant contained within the tube flow channels and external air passing over the tubes. Multichannel heat exchangers may be used in small tonnage systems, such as residential systems, or in large tonnage systems, such as industrial chiller systems.

In general, heat exchangers transfer heat by circulating a refrigerant through a cycle of evaporation and condensation. In many systems, the refrigerant changes phases while flowing through heat exchangers in which evaporation and condensation occur. For example, the refrigerant may enter an evaporator heat exchanger as a liquid and exit as a vapor. In another example, the refrigerant may enter a condenser heat exchanger as a vapor and exit as a liquid. Typically, a portion of the heat transfer is achieved from the phase change that occurs within the heat exchangers. That is, while some energy is transferred to and from the refrigerant by changes in the temperature of the fluid (i.e., sensible heat), much more energy is exchanges by phase changes (i.e., latent heat). For example, in the case of an evaporator, the external air is cooled when the liquid refrigerant flowing through the heat exchanger absorbs heat from the air causing the liquid refrigerant to change to a vapor. Therefore, it is intended that the refrigerant entering an evaporator contain as much liquid as possible to promote heat transfer. If the refrigerant enters an evaporator as a vapor, it may not be able to absorb as much heat and, thus, may not be able to cool the external air as effectively.

In general, an expansion device is located in a closed loop prior to the evaporator. The expansion device lowers the temperature and pressure of the refrigerant by increasing its volume. However, during the expansion process, some of the liquid refrigerant may be expanded to vapor. Therefore, a mixture of liquid and vapor refrigerant typically enters the evaporator. Because the vapor refrigerant has a lower density than the liquid refrigerant, the vapor refrigerant tends to separate from the liquid refrigerant resulting in some multichannels receiving all mostly vapor. The tubes containing primarily vapor may not able to absorb much heat, which may result in inefficient heat transfer.

SUMMARY

In accordance with aspects of the invention, a heat exchanger and a multichannel tube for a heat exchanger are presented. The heat exchanger includes a first manifold, a second manifold, and a plurality of multichannel tubes in fluid communication with the manifolds. The multichannel tubes include a plurality of generally parallel flow paths extending along the length of the multichannel tubes. The flow paths are divided by interior walls that are interrupted along the length of the tubes to permit mixing of fluid flowing through the flow paths.

In accordance with further aspects of the invention, a method for promoting heat exchange to or from a liquid is presented. The method includes introducing the fluid into a first manifold of a heat exchanger, flowing the fluid through a plurality of multichannel tubes in communication with the first manifold, and collecting the fluid from the multichannel tubes in a second manifold. The multichannel tubes include a plurality of generally parallel flow paths extending along their length divided by interior walls that are interrupted along the length of the tubes to permit mixing of the fluid flowing through the flow paths,

DRAWINGS

FIG. 1 is a perspective view of an exemplary residential air conditioning or heat pump system of the type that might employ a heat exchanger.

FIG. 2 is a partially exploded view of the outside unit of the system of FIG. 1, with an upper assembly lifted to expose certain of the system components, including a heat exchanger.

FIG. 3 is a perspective view of an exemplary commercial or industrial HVAC&R system that employs a chiller and air handlers to cool a building and that may employ heat exchangers.

FIG. 6 is a perspective view of an exemplary heat exchanger containing internal tube configurations.

FIG. 7 is a partially exploded detail perspective view of an exemplary multichannel tube.

DETAILED DESCRIPTION

Figure 4:
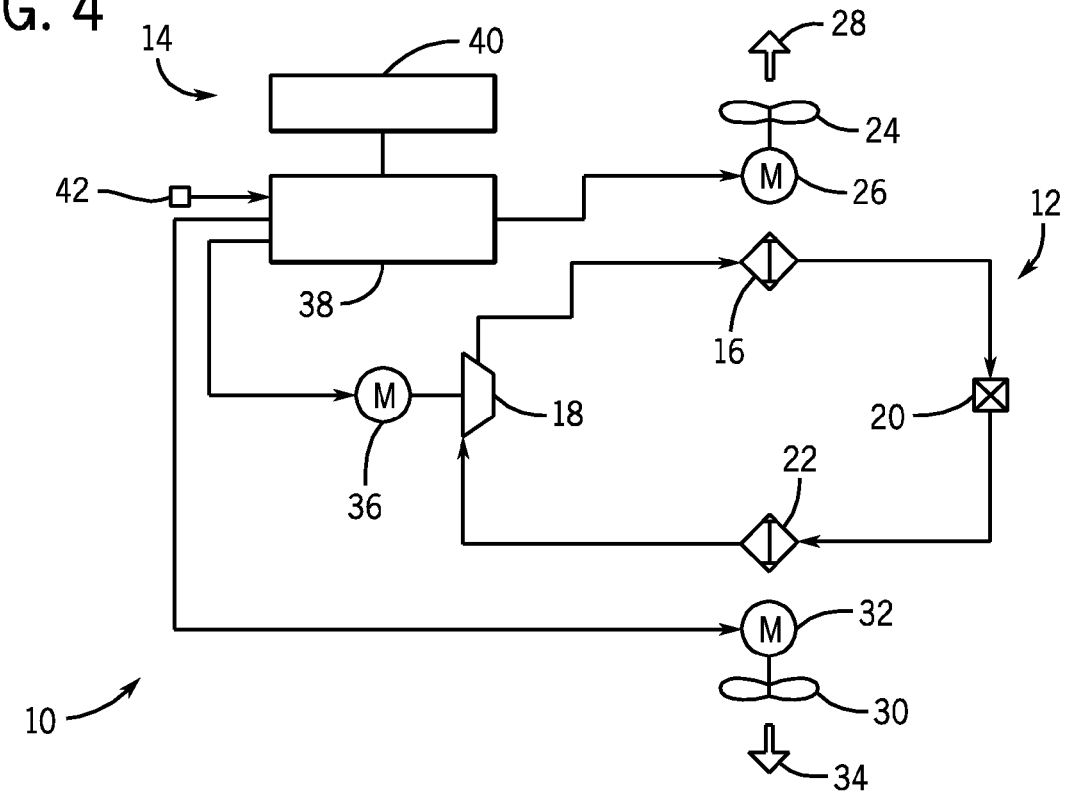
FIG. 4 is a diagrammatical overview of an exemplary air conditioning system, which may employ one or more heat exchangers with internal tube configurations.

FIGS. 1-3 depict exemplary applications for heat exchangers. Such systems, in general, may be applied in a range of settings, both within the HVAC&R field and outside of that field. In presently contemplated applications, however, heat exchanges may be used in residential, commercial, light industrial, industrial and in any other application for heating or cooling a volume or enclosure, such as a residence, building, structure, and so forth. Moreover, the heat exchanges may be used in industrial applications, where appropriate, for basic refrigeration and heating of various fluids. FIG. 1 illustrates a residential heating and cooling system. In general, a residence, designated by the letter R, will be equipped with an outdoor unit OU that is operatively coupled to an indoor unit IU. The outdoor unit is typically situated adjacent to a side of the residence and is covered by a shroud to protect the system components and to prevent leaves and other contaminants from entering the unit. The indoor unit may be positioned in a utility room, an attic, a basement, and so forth. The outdoor unit is coupled to the indoor unit by refrigerant conduits RC that transfer primarily liquid refrigerant in one direction and primarily vaporized refrigerant in an opposite direction.

When the system shown in FIG. 1 is operating as an air conditioner, a coil in the outdoor unit serves as a condenser for recondensing vaporized refrigerant flowing from indoor unit IU to outdoor unit OU via one of the refrigerant conduits. In these applications, a coil of the indoor unit, designated by the reference characters IC, serves as an evaporator coil. The evaporator coil receives liquid refrigerant (which may be expanded by an expansion device described below) and evaporates the refrigerant before returning it to the outdoor unit.

The outdoor unit draws in environmental air through sides as indicated by the arrows directed to the sides of unit OU, forces the air through the outer unit coil by a means of a fan (not shown) and expels the air as indicated by the arrows above the outdoor unit. When operating as an air conditioner, the air is heated by the condenser coil within the outdoor unit and exits the top of the unit at a temperature higher than it entered the sides. Air is blown over indoor coil IC, and is then circulated through the residence by means of ductwork D, as indicated by the arrows in FIG. 1. The overall system operates to maintain a desired temperature as set by a thermostat T. When the temperature sensed inside the residence is higher than the set point on the thermostat (plus a small amount), the air conditioner will become operative to refrigerate additional air for circulation through the residence. When the temperature reaches the set point (minus a small amount), the unit will stop the refrigeration cycle temporarily.

When the unit in FIG. 1 operates as a heat pump, the roles of the coils are simply reversed. That is, the coil of the outdoor unit will serve as an evaporator to evaporate refrigerant and thereby cool air entering the outdoor unit as the air passes over the outdoor unit coil. Indoor coil IC will receive a stream of air blown over it and will heat the air by condensing a refrigerant.

FIG. 2 illustrates a partially exploded view of one of the units shown in FIG. 1, in this case outdoor unit OU. In general, the unit may be thought of as including an upper assembly UA made up of a shroud, a fan assembly, a fan drive motor, and so forth. In the illustration of FIG. 2, the fan and fan drive motor are not visible because they are hidden by the surrounding shroud. An outdoor coil OC is housed within this shroud and is generally deposed to surround or at least partially surround other system components, such as a compressor, an expansion device, a control circuit.

FIG. 3 illustrates another exemplary application, in this case an HVAC&R system for building environmental management. A building BL is cooled by a system that includes a chiller CH, which is typically disposed on or near the building, or in an equipment room or basement. Chiller CH is an air-cooled device that implements a refrigeration cycle to cool water. The water is circulated to a building through water conduits WC. The water conduits are routed to air handlers AH at individual floors or sections of the building. The air handlers are also coupled to ductwork DU that is adapted to blow air from an outside intake OI.

Chiller CH, which includes heat exchangers for both evaporating and condensing a refrigerant, cools water that is circulated to the air handlers. Air blown over additional coils that receive the water in the air handlers causes the water to increase in temperature and the circulated air to decrease in temperature. The cooled air is then routed to various locations in the building via additional ductwork. Ultimately, distribution of the air is routed to diffusers that deliver the cooled air to offices, apartments, hallways, and any other interior spaces within the building. In many applications, thermostats or other command devices (not shown in FIG. 3) will serve to control the flow of air through and from the individual air handlers and ductwork to maintain desired temperatures at various locations in the structure.

FIG. 4 illustrates an air conditioning system 10, which uses multichannel tubes. Refrigerant flows through the system within closed refrigeration loop 12. The refrigerant may be any fluid that absorbs and extracts heat. For example, the refrigerant may be hydrofluorocarbon (HFC) based R-410A, R-407, or R-134a, or it may be carbon dioxide (R-744a) or ammonia (R-717). Air conditioning system 10 includes control devices 14 that enable system 10 to cool an environment to a prescribed temperature.

System 10 cools an environment by cycling refrigerant within closed refrigeration loop 12 through condenser 16, compressor 18, expansion device 20, and evaporator 22. The refrigerant enters condenser 16 as a high pressure and temperature vapor and flows through the multichannel tubes of condenser 16. A fan 24, which is driven by a motor 26, draws air across the multichannel tubes. The fan may push or pull air across the tubes. Heat transfers from the refrigerant vapor to the air producing heated air 28 and causing the refrigerant vapor to condense into a liquid. The liquid refrigerant then flows into an expansion device 20 where the refrigerant expands to become a low pressure and temperature liquid. Typically, expansion device 20 will be a thermal expansion valve (TXV); however, in other embodiments, the expansion device may be an orifice or a capillary tube. After the refrigerant exits the expansion device, some vapor refrigerant may be present in addition to the liquid refrigerant.

From expansion device 20, the refrigerant enters evaporator 22 and flows through the evaporator multichannel tubes. A fan 30, which is driven by a motor 32, draws air across the multichannel tubes. Heat transfers from the air to the refrigerant liquid producing cooled air 34 and causing the refrigerant liquid to boil into a vapor. In some embodiments, the fan may be replaced by a pump that draws fluid across the multichannel tubes.

The refrigerant then flows to compressor 18 as a low pressure and temperature vapor. Compressor 18 reduces the volume available for the refrigerant vapor, consequently, increasing the pressure and temperature of the vapor refrigerant. The compressor may be any suitable compressor such as a screw compressor, reciprocating compressor, rotary compressor, swing link compressor, scroll compressor, or turbine compressor. Compressor 18 is driven by a motor 36 that receives power from a variable speed drive (VSD) or a direct AC or DC power source. In one embodiment, motor 36 receives fixed line voltage and frequency from an AC power source although in some applications the motor may be driven by a variable voltage or frequency drive. The motor may be a switched reluctance (SR) motor, an induction motor, an electronically commutated permanent magnet motor (ECM), or any other suitable motor type. The refrigerant exits compressor 18 as a high temperature and pressure vapor that is ready to enter the condenser and begin the refrigeration cycle again.

The operation of the refrigeration cycle is governed by control devices 14 that include control circuitry 38, an input device 40, and a temperature sensor 42. Control circuitry 38 is coupled to motors 26, 32, and 36, which drive condenser fan 24, evaporator fan 30, and compressor 18, respectively. The control circuitry uses information received from input device 40 and sensor 42 to determine when to operate motors 26, 32, and 36, which drive the air conditioning system. In some applications, the input device may be a conventional thermostat. However, the input device is not limited to thermostats, and more generally, any source of a fixed or changing set point may be employed. These may include local or remote command devices, computer systems and processors, mechanical, electrical and electromechanical devices that manually or automatically set a temperature-related signal that the system receives. For example, in a residential air conditioning system, the input device may be a programmable 24-volt thermostat that provides a temperature set point to the control circuitry. Sensor 42 determines the ambient air temperature and provides the temperature to control circuitry 38. Control circuitry 38 then compares the temperature received from the sensor to the temperature set point received from the input device. If the temperature is higher than the set point, control circuitry 38 may turn on motors 26, 32, and 36 to run air conditioning system 10. Additionally, the control circuitry may execute hardware or software control algorithms to regulate the air conditioning system. In some embodiments, the control circuitry may include an analog to digital (A/D) converter, a microprocessor, a non-volatile memory, and an interface board. Other devices may, of course, be included in the system, such as additional pressure and/or temperature transducers or switches that sense temperatures and pressures of the refrigerant, the heat exchangers, the inlet and outlet air, and so forth.

Figure 5:
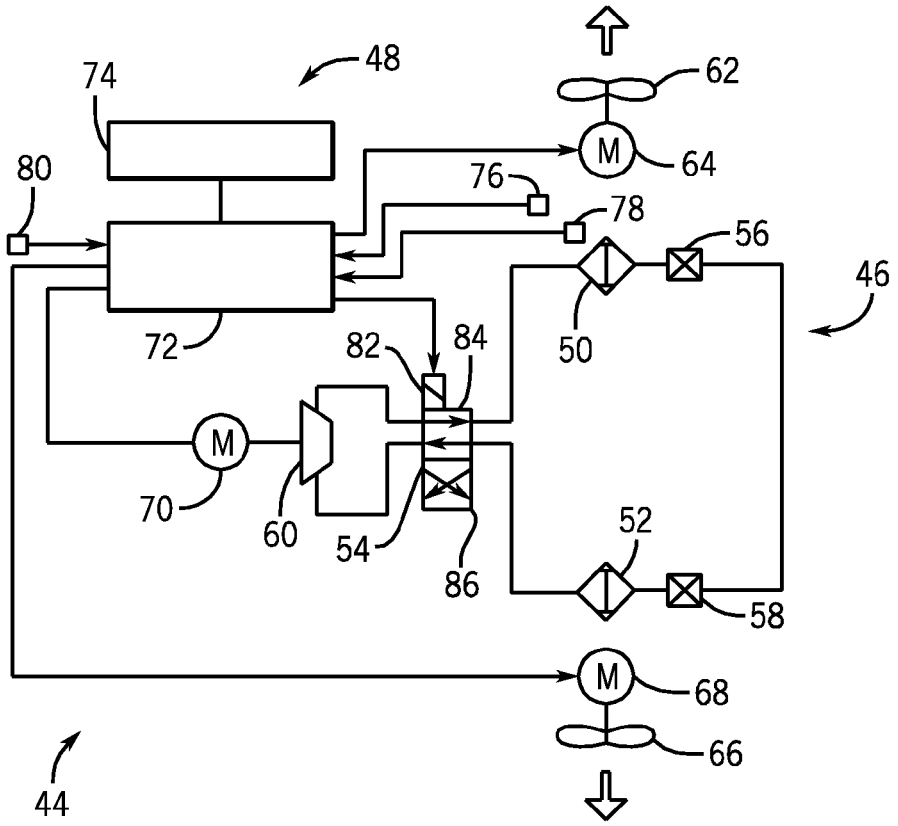
FIG. 5 is a diagrammatical overview of an exemplary heat pump system, which may employ one or more heat exchangers with internal tube configurations.

FIG. 5 illustrates a heat pump system 44 that uses multichannel tubes. Because the heat pump may be used for both heating and cooling, refrigerant flows through a reversible refrigeration/heating loop 46. The refrigerant may be any fluid that absorbs and extracts heat. The heating and cooling operations are regulated by control devices 48.

Heat pump system 44 includes an outside coil 50 and an inside coil 52 that both operate as heat exchangers. The coils may function either as an evaporator or as a condenser depending on the heat pump operation mode. For example, when heat pump system 44 is operating in cooling (or "AC") mode, outside coil 50 functions as a condenser, releasing heat to the outside air, while inside coil 52 functions as an evaporator, absorbing heat from the inside air. When heat pump system 44 is operating in heating mode, outside coil 50 functions as an evaporator, absorbing heat from the outside air, while inside coil 52 functions as a condenser, releasing heat to the inside air. A reversing valve 54 is positioned on reversible loop 46 between the coils to control the direction of refrigerant flow and thereby to switch the heat pump between heating mode and cooling mode.

Heat pump system 44 also includes two metering devices 56 and 58 for decreasing the pressure and temperature of the refrigerant before it enters the evaporator. The metering device also acts to regulate refrigerant flow into the evaporator so that the amount of refrigerant entering the evaporator equals the amount of refrigerant exiting the evaporator. The metering device used depends on the heat pump operation mode. For example, when heat pump system 44 is operating in cooling mode, refrigerant bypasses metering device 56 and flows through metering device 58 before entering the inside coil 52, which acts as an evaporator. In another example, when heat pump system 44 is operating in heating mode, refrigerant bypasses metering device 58 and flows through metering device 56 before entering outside coil 50, which acts as an evaporator. In other embodiments, a single metering device may be used for both heating mode and cooling mode. The metering devices typically are thermal expansion valves (TXV), but also may be orifices or capillary tubes.

The refrigerant enters the evaporator, which is outside coil 50 in heating mode and inside coil 52 in cooling mode, as a low temperature and pressure liquid. Some vapor refrigerant also may be present as a result of the expansion process that occurs in metering device 56 or 58. The refrigerant flows through multichannel tubes in the evaporator and absorbs heat from the air changing the refrigerant into a vapor. In cooling mode, the indoor air passing over the multichannel tubes also may be dehumidified. The moisture from the air may condense on the outer surface of the multichannel tubes and consequently be removed from the air.

After exiting the evaporator, the refrigerant passes through reversing valve 54 and into compressor 60. Compressor 60 decreases the volume of the refrigerant vapor, thereby, increasing the temperature and pressure of the vapor. The compressor may be any suitable compressor such as a screw compressor, reciprocating compressor, rotary compressor, swing link compressor, scroll compressor, or turbine compressor.

From the compressor, the increased temperature and pressure vapor refrigerant flows into a condenser, the location of which is determined by the heat pump mode. In cooling mode, the refrigerant flows into outside coil 50 (acting as a condenser). A fan 62, which is powered by a motor 64, draws air over the multichannel tubes containing refrigerant vapor. In some embodiments, the fan may be replaced by a pump that draws fluid across the multichannel tubes. The heat from the refrigerant is transferred to the outside air causing the refrigerant to condense into a liquid. In heating mode, the refrigerant flows into inside coil 52 (acting a condenser). A fan 66, which is powered by a motor 68, draws air over the multichannel tubes containing refrigerant vapor. The heat from the refrigerant is transferred to the inside air causing the refrigerant to condense into a liquid.

After exiting the condenser, the refrigerant flows through the metering device (56 in heating mode and 58 in cooling mode) and returns to the evaporator (outside coil 50 in heating mode and inside coil 52 in cooling mode) where the process begins again.

In both heating and cooling modes, a motor 70 drives compressor 60 and circulates refrigerant through reversible refrigeration/heating loop 46. The motor may receive power either directly from an AC or DC power source or from a variable speed drive (VSD). The motor may be a switched reluctance (SR) motor, an induction motor, an electronically commutated permanent magnet motor (ECM), or any other suitable motor type.

The operation of motor 70 is controlled by control circuitry 72. Control circuitry 72 receives information from an input device 74 and sensors 76, 78, and 80 and uses the information to control the operation of heat pump system 44 in both cooling mode and heating mode. For example, in cooling mode, input device 74 provides a temperature set point to control circuitry 72. Sensor 80 measures the ambient indoor air temperature and provides it to control circuitry 72. Control circuitry 72 then compares the air temperature to the temperature set point and engages compressor motor 70 and fan motors 64 and 68 to run the cooling system if the air temperature is above the temperature set point. In heating mode, control circuitry 72 compares the air temperature from sensor 80 to the temperature set point from input device 74 and engages motors 64, 68, and 70 to run the heating system if the air temperature is below the temperature set point.

Control circuitry 72 also uses information received from input device 74 to switch heat pump system 44 between heating mode and cooling mode. For example, if input device 74 is set to cooling mode, control circuitry 72 will send a signal to a solenoid 82 to place reversing valve 54 in air conditioning position 84. Consequently, the refrigerant will flow through reversible loop 46 as follows: the refrigerant exits compressor 60, is condensed in outside coil 50, is expanded by metering device 58, and is evaporated by inside coil 52. If the input device is set to heating mode, control circuitry 72 will send a signal to solenoid 82 to place reversing valve 54 in heat pump position 86. Consequently, the refrigerant will flow through the reversible loop 46 as follows: the refrigerant exits compressor 60, is condensed in inside coil 52, is expanded by metering device 56, and is evaporated by outside coil 50.

The control circuitry may execute hardware or software control algorithms to regulate the heat pump system 44. In some embodiments, the control circuitry may include an analog to digital (A/D) converter, a microprocessor, a non-volatile memory, and an interface board.

The control circuitry also may initiate a defrost cycle when the system is operating in heating mode. When the outdoor temperature approaches freezing, moisture in the outside air that is directed over outside coil 50 may condense and freeze on the coil. Sensor 76 measures the outside air temperature, and sensor 78 measures the temperature of outside coil 50. These sensors provide the temperature information to the control circuitry which determines when to initiate a defrost cycle. For example, if either of sensors 76 or 78 provides a temperature below freezing to the control circuitry, system 44 may be placed in defrost mode. In defrost mode, solenoid 82 is actuated to place reversing valve 54 in air conditioning position 84, and motor 64 is shut off to discontinue air flow over the multichannels. System 44 then operates in cooling mode until the increased temperature and pressure refrigerant flowing through outside coil 50 defrosts the coil. Once sensor 78 detects that coil 50 is defrosted, control circuitry 72 returns the reversing valve 54 to heat pump position 86. The defrost cycle can be set to occur at many different time and temperature combinations.

FIG. 6 is a perspective view of an exemplary heat exchanger that may be used in air conditioning system 10 or heat pump system 44. The exemplary heat exchanger may be a condenser 16, an evaporator 22, an outside coil 50, or an inside coil 52, as shown in FIGS. 4 and 5. It should also be noted that in similar or other systems, the heat exchanger may be used as part of a chiller or in any other heat exchanging application. The heat exchanger includes manifolds 88 and 90 that are connected by multichannel tubes 92. Although 30 tubes are shown in FIG. 6, the number of tubes may vary. The manifolds and tubes may be constructed of aluminum or any other material that promotes good heat transfer. Refrigerant flows from manifold 88 through first tubes 94 to manifold 90. The refrigerant then returns to manifold 88 through second tubes 96. In some embodiments, the heat exchanger may be rotated approximately 90 degrees so that the multichannel tubes run vertically between a top manifold and a bottom manifold. The heat exchanger may be inclined at an angle relative to the vertical. Furthermore, although the multichannel tubes are depicted as having an oblong shape, the tubes may be any shape, such as tubes with a cross-section in the form of a rectangle, square, circle, oval, ellipse, triangle, trapezoid, or parallelogram. In some embodiments, the tubes may have a diameter ranging from 0.5 mm to 3 mm. It should also be noted that the heat exchanger may be provided in a single plane or slab, or may include bends, corners, contours, and so forth.

In some embodiments, the construction of first tubes 94 may differ from the construction of the second tubes 96. Tubes may also differ within each section. For example, the tubes may all have identical cross sections, or the tubes in the first section may be rectangular while the tubes in the second section are oval. The internal construction of the tubes may vary within and across tube sections.

Returning to FIG. 6, refrigerant enters the heat exchanger through an inlet 98 and exits the heat exchanger through an outlet 100. Although FIG. 6 depicts the inlet at the top of manifold 88 and the outlet at the bottom of the manifold, the inlet and outlet positions may be interchanged so that fluid enters at the bottom and exits at the top. The fluid also may enter and exit the manifold from multiple inlets and outlets positioned on bottom, side, or top surfaces of the manifold. Baffles 102 separate the inlet 98 and outlet 100 portions of manifold 88. Although a double baffle 102 is illustrated, any number of one or more baffles may be employed to create separation of inlet 98 and outlet 100.

Fins 104 are located between multichannel tubes 92 to promote the transfer of heat between tubes 92 and the environment. In one embodiment, the fins are constructed of aluminum, brazed or otherwise joined to the tubes, and disposed generally perpendicular to the flow of refrigerant. However, in other embodiments the fins may be made of other materials that facilitate heat transfer and may extend parallel or at varying angles with respect to the flow of the refrigerant. The fins may be louvered fins, corrugated fins, or any other suitable type of fin.

Refrigerant exits the expansion device as a low pressure and temperature liquid and enters the evaporator. As the liquid travels through first multichannel tubes 94, the liquid absorbs heat from the outside environment causing the liquid warm from its subcooled temperature (i.e., a number of degrees below the boiling point). Then, as the liquid refrigerant travels through second multichannel tubes 96, the liquid absorbs more heat from the outside environment causing it to boil into a vapor. Although evaporator applications typically use liquid refrigerant to absorb heat, some vapor may be present along with the liquid due to the expansion process. The amount of vapor may vary based on the type of refrigerant used. In some embodiments, the refrigerant may contain approximately 15% vapor by weight and 90% vapor by volume. This vapor has a lower density than the liquid, causing the vapor to separate from the liquid within the manifold 88. Consequently, certain flow channels of tubes 92 may contain mostly vapor.

FIG. 7 shows a perspective view of a tube 92 shown in FIG. 6. Refrigerant flows through flow channels 106 contained within tube 92. The direction of fluid flow 108 is from manifold 88 shown in FIG. 6 to manifold 90 shown in FIG. 6 within the first tubes. The direction of fluid flow is reversed within the second tubes. Because the refrigerant within manifold 88 is a mixture of liquid phase and vapor phase refrigerant, flow channels 106 may contain some liquid and some vapor. Because of the density difference, which generally causes separation of phases, some flow channels within a channel section 110 may contain only vapor phase refrigerant while other flow channels may contain only liquid phase refrigerant. The flow channels containing only vapor phase refrigerant may not able to absorb as much heat because the refrigerant has already changed phases.

After flowing through channel section 110, the refrigerant reaches open section 112. In open section 112, the interior walls that form the flow channels have been removed or interrupted. Consequently, open section 112 includes an open channel 114 spanning the width W of tube 92 where mixing of the two phases of refrigerant can occur. Mixed flow 118 occurs within this section causing fluid flow 108 exiting flow channels 106 to cross paths and mix. Thus, flow channels containing all (or primarily) vapor phase may mix with flow channels containing all (or primarily) liquid phase, providing a more homogenous distribution of refrigerant. Flow channels containing different percentages of vapor and liquid may also mix.

From open section 112, the refrigerant enters flow channels 120 contained within channel section 122. Fluid flow 124 through these channels may contain a more even distribution of vapor and liquid phases due to the mixed flow 118 that occurred within open channel 114. Tube 92 may contain any number of open sections 112 where mixing may occur. Thus, rather than primarily vapor to be channeled through certain flow paths, the internal wall interruptions permit mixing of the phases, allowing increased phase change to occur in all of the flow paths (through which an increasingly mixed phase flow will be channeled). The internal wall interruptions also allow the tubes to be segregated into sections for repair purposes. For example, if a flow channel contained within channel section 110 becomes blocked, plugged, or requires repair, that section of the flow channel may be removed from service or bypassed while the corresponding flow channel within channel section 122 continues to receive refrigerant flow.

Figure 8:
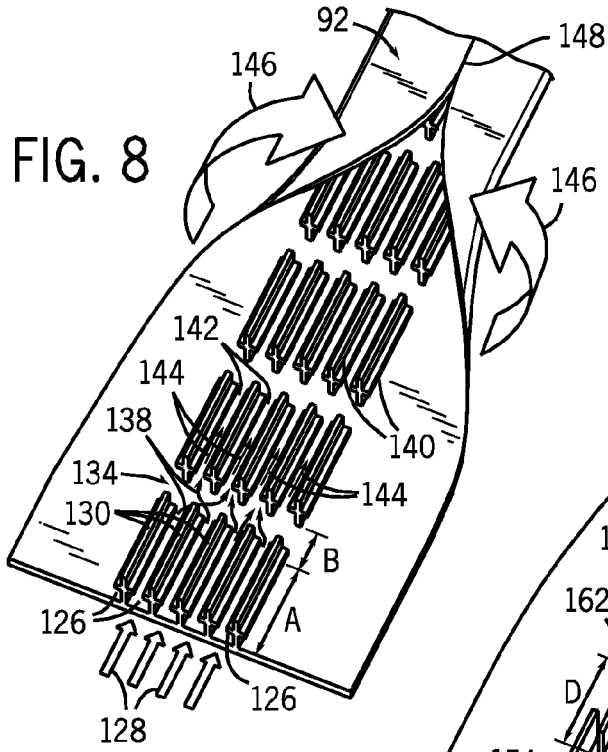
FIG. 8 is a detail perspective view of an exemplary multichannel tube.

FIG. 8 is a perspective view of an alternate embodiment of tubes 92 shown in FIG. 6. Refrigerant enters flow channels 126 in the direction of fluid flow 128. Flow channels 126 are formed from interior walls 130. The interior walls may have a cross-section in the shape of a cross, which increases the surface area for heat transfer and provides mechanical support within the tube. In other embodiments, the cross-section may include other shapes such as a "T," an "X," or a star. Flow channels 126 have a length A, after which fluid flow 128 enters an open section 134 of length B. In open section 134, fluid flow 128 may mix to form a mixed flow 138. Mixed flow 138 allows the flow from each channel to mix creating a more homogenous phase distribution within tube 92.

After open section 134, the fluid flow contacts more interior walls 140 that force the refrigerant into flow channels 142. Fluid flow 144 may be a more homogenous mixture of liquid and vapor refrigerant because it has passed through an open section 134 where flow mixing has occurred, as indicated generally by reference numeral 138.

As shown in FIG. 8, interior walls 140 have the same cross-section as the previous interior walls 130. However, in other embodiments, the cross-sections may be different shapes in subsequent flow channel sections. Additionally, there may be any number of open sections of varying lengths dispersed between flow channel sections of varying lengths.

In one embodiment, interior walls 130 and 140 may be extruded when the tube is flat. The ends of the tube may be wrapped in a direction 146 to form a shell around the interior walls. A seam 148 may be used to join the ends of the tube together. Although the tube formed in FIG. 8 is oblong, the tube may be any shape.

Figure 9:
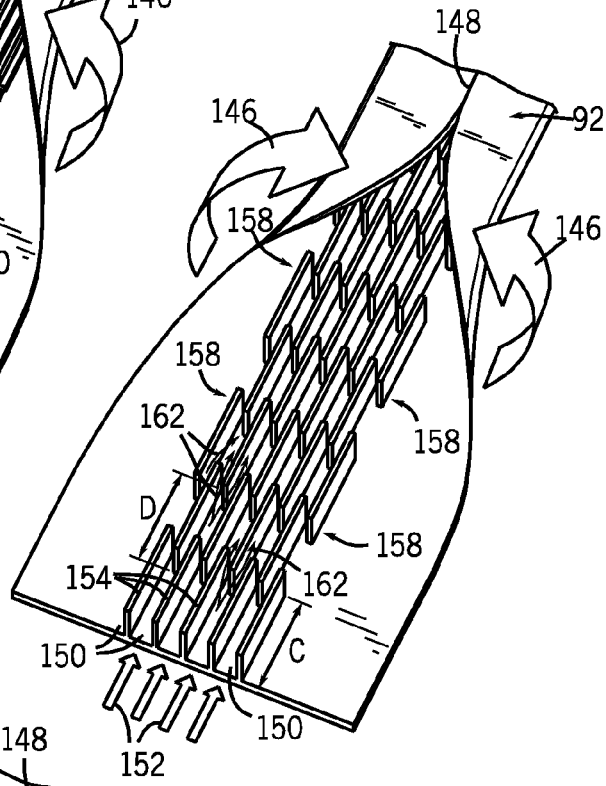
FIG. 9 is a detail perspective view of an exemplary multichannel tube.

FIG. 9 is a perspective view of another alternate embodiment of tubes 92 shown in FIG. 6. Refrigerant enters flow channels 150 in the direction of fluid flow 152. Flow channels 150 are formed from interior walls 154. Interior walls 154 may have a length C that is substantially shorter than the overall length of the tube itself. After the refrigerant flows down length C, it reaches a staggered section 158 where fluid flow 152 may mix. The interior walls within staggered section 158 may have a stagger, or overlap, length D. This length may be uniform within the staggered section or it may vary. Length D may be the same length as length C or it may differ from length C. It is intended that the staggering of the interior walls promotes mixed flow 162, which creates mixing of the liquid and refrigerant phases. In other embodiments, the interior walls may be of varying lengths and may contain intermittent gap sections extending the width of the tube between staggered sections.

As in previous embodiments, interior walls 154 may be extruded when the tube is flat. The ends of tube 92 may be wrapped in a direction 146 to form a shell around the interior walls. A seam 148 may be used to join the ends of the tube together. Although the tube formed in FIG. 9 is oblong, the tube may be any shape.

Figure 10:
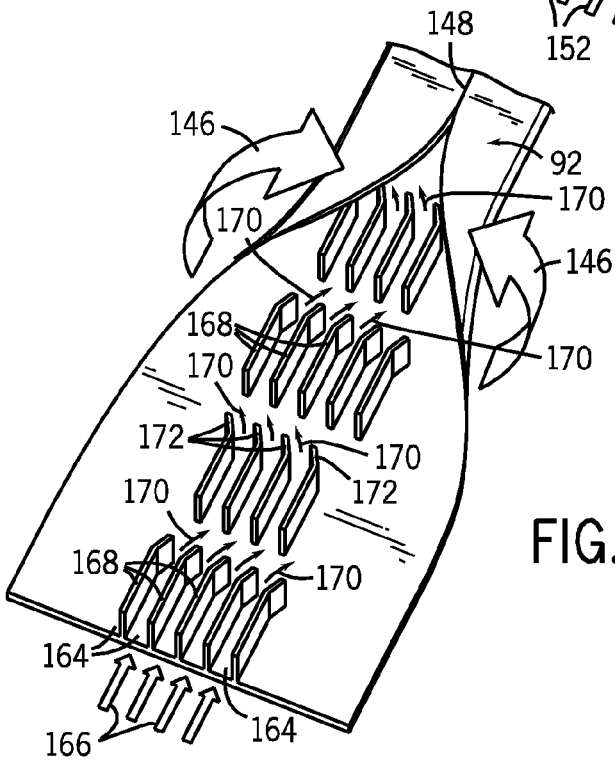
FIG. 10 is a detail perspective view of an exemplary multichannel tube.

FIG. 10 is a perspective view of another alternate embodiment of tubes 92 shown in FIG. 6. Refrigerant enters flow channels 164 in the direction of fluid flow 166. Flow channels 164 are formed from interior walls 168. Mixed flow 170 may occur in sections containing no interior walls. The fluid may contact an angled portion 172 of the interior walls, which creates mixed flow 170. The angled portions may direct refrigerant into an adjacent channel, thus, promoting mixing between the channels. In other embodiments, the interior walls may be staggered to promote additional mixing of the refrigerant. In some embodiments, the entire portion of some interior walls may be angled. The mixing may result in a more homogenous distribution of refrigerant within the multichannel tubes.

Interior walls 168 may be extruded from a flat piece of metal that is folded over to form a shell around the flow channels. The ends of the tube may be wrapped in a direction 146 to form the tube 92. A seam 148 may be used to join the ends of the tube together. Although the tube formed in FIG. 10 is oblong, the tube may be any shape.

The internal tube configurations described herein may find application in a variety of heat exchangers and HVAC&R systems containing heat exchangers. However, the configurations are particularly well-suited to evaporators used in residential air conditioning and heat pump systems and are intended to provide a more homogenous distribution of vapor phase and liquid phase refrigerant within heat exchanger tubes.

It should be noted that the present discussion makes use of the term "multichannel" tubes or "multichannel heat exchanger" to refer to arrangements in which heat transfer tubes include a plurality of flow paths between manifolds that distribute flow to and collect flow from the tubes. A number of other terms may be used in the art for similar arrangements. Such alternative terms might include "microchannel" and "microport." The term "microchannel" sometimes carries the connotation of tubes having fluid passages on the order of a micrometer and less. However, in the present context such terms are not intended to have any particular higher or lower dimensional threshold. Rather, the term "multichannel" used to describe and claim embodiments herein is intended to cover all such sizes. Other terms sometimes used in the art include "parallel flow" and "brazed aluminum". However, all such arrangements and structures are intended to be included within the scope of the term "multichannel." In general, such "multichannel" tubes will include flow paths disposed along the width or in a plane of a generally flat, planar tube, although, again, the invention is not intended to be limited to any particular geometry unless otherwise specified in the appended claims.

While only certain features of the invention have been illustrated and described herein, many modifications and changes will occur to those skilled in the art. It is, therefore, to be understood that the appended claims are intended to cover all such modifications and changes as fall within the true spirit of the invention. Furthermore, in an effort to provide a concise description of the exemplary embodiments, all features of an actual implementation may not have been described. It should be appreciated that in the development of any such actual implementation, as in any engineering or design project, numerous implementation specific decisions must be made. Such a development effort might be complex and time consuming, but would nevertheless be a routine undertaking of design, fabrication, and manufacture for those of ordinary skill having the benefit of this disclosure.

The invention claimed is:

1. A heat exchanger comprising:

a first manifold;

a second manifold;

a plurality of multichannel tubes in fluid communication with the first manifold and the second manifold, the multichannel tubes including a plurality of generally parallel flow paths extending along their length and divided from one another by interior walls, the interior walls being interrupted along the length of the multichannel tubes to form mixing sections that permit mixing of fluid from all flow paths through which fluid flows within each multichannel tube.

2. The heat exchanger of claim 1, wherein at least some of the interior walls are angled to direct mixing flow into adjacent flow paths disposed downstream of the mixing sections.

3. The heat exchanger of claim 1, wherein the multichannel tubes each comprise a flat piece of metal that is folded over to form a metallic shell wrapped around the interior walls and joined together at a seam to form the respective multichannel tube.

4. The heat exchanger of claim 1, comprising fins disposed between the multichannel tubes for transferring heat to or from the fluid flowing through the flow paths during operation.

5. The heat exchanger of claim 1, wherein the first manifold and the outlet manifold are configured for mounting in a generally vertical orientation.

6. The heat ex changer of claim 1, wherein the multichannel tubes are generally flat in cross-section, and the flow paths are aligned generally along widths of the multichannel tubes.

7. The heat exchanger of claim 1, wherein the interior walls comprise first interior walls disposed along a first length of the multichannel tubes and second interior walls disposed along a second length of the multichannel tubes downstream of the first length, and wherein the mixing sections comprise a staggered section where each of the second interior walls is disposed in between two of the first interior walls and overlaps lengthwise with a portion of the two first interior walls.

8. The heat exchanger of claim 1, wherein the multichannel tubes include channel sections in which the interior walls extend parallel to one another to form the flow paths therebetween, and wherein the mixing sections comprise open channels that span the width of the multichannel tubes to permit mixing of the fluid exiting the channel sections.

9. A multichannel tube for a heat exchanger comprising:

a channel section with a plurality of generally parallel flow paths extending along the length of the channel section and divided from one another by interior walls; and an open section disposed where the interior walls are interrupted along the length of the tubes to form an open channel that spans the width of the multichannel tube to permit mixing of fluid exiting the flow paths of the channel section.

10. The multichannel tube of claim 9, wherein at least one of the interior walls is angled to direct mixing flow within the open section from a first flow path within the channel section towards a downstream flow path disposed at a different position along the width than the first flow path.

11. The multichannel tube of claim 9, wherein the multichannel tubes each comprise a flat piece of metal that is folded over to form a metallic shell wrapped around the interior walls and joined together at a seam to form the multichannel tubes.

12. The heat exchanger of claim 8, wherein the interior walls isolate the flow paths from one another within the channel sections.

13. The multichannel tube of claim 9, comprising an additional channel section disposed downstream of the open section, wherein the additional channel section includes another plurality of generally parallel flow paths extending along the length of the additional channel section.

14. A method for promoting heat exchange to or from a fluid comprising:

introducing the fluid into a first manifold of a heat exchanger;

flowing the fluid through a plurality of multichannel tubes in fluid communication with the first manifold, the multichannel tubes including a plurality of generally parallel flow paths extending along their length and divided from one another by interior walls, the interior walls being interrupted along the length of the multichannel tubes to form mixing sections that permit mixing of fluid from all separate flow paths through which fluid flows within each multichannel tube; and collecting the fluid from the multichannel tubes in a second manifold.

15. The method of claim 14, wherein the fluid is introduced in a mixed phase such that fluid introduced into at least some of the flow paths is primarily vapor and fluid introduced into other flow paths is primarily liquid.

16. The method of claim 15, wherein the vapor and liquid phase fluids are mixed within the multichannel tubes by communication in the mixing sections.

17. The method of claim 14, wherein at least some of the interior walls are angled to direct mixing flow into adjacent flow paths disposed downstream of the mixing sections, and wherein the fluid within each tube is redirected by the angled interior walls.

18. The method of claim 14, wherein the interior walls comprise first interior walls disposed along a first length of the multichannel tubes and second interior walls disposed along a second length of the multichannel tubes downstream of the first length, wherein the mixing sections comprise a staggered section where each of the second interior walls is disposed in between two of the first interior walls and overlaps lengthwise with a portion of the two first interior walls, and wherein the fluid from the separate flow paths mixes as the fluid flows through the staggered section.

19. The method of claim 14, wherein the multichannel tubes include channel sections in which the interior walls extend parallel to one another to form the flow paths therebetween, wherein the mixing sections comprise open channels that span the width of the multichannel tubes to permit mixing of the fluid, and wherein the fluid from the separate flow paths mixes as the fluid exits the channel sections and flows into the open channels.

20. A method for promoting heat exchange to or from a fluid comprising:

introducing a mixed phase fluid into a first manifold of a heat exchanger;

flowing the fluid through channel sections of a plurality of multichannel tubes in fluid communication with the first manifold, the channel sections including a plurality of generally parallel flow paths extending along their length and divided from one another by interior walls;

flowing the fluid through open sections where the interior walls are interrupted along the lengths of the tubes to form open channels that span the widths of the multichannel tubes to permit mixing of fluid exiting all of the flow paths of the channel sections through which fluid flows;

mixing vapor and liquid phase flows in the open sections; and collecting the fluid from the multichannel tubes in a second manifold.

21. A heating, ventilating, air conditioning or refrigeration system comprising:

a compressor configured to compress a gaseous refrigerant;

a condenser configured to receive and to condense the compressed refrigerant;

an expansion device configured to reduce pressure of the condensed refrigerant; and an evaporator configured to evaporate the refrigerant prior to returning the refrigerant to the compressor;

wherein at least one of the condenser and the evaporator includes a heat exchanger having a first manifold, a second manifold, and a plurality of multichannel tubes in fluid communication with the first manifold and the second manifold, the multichannel tubes including a plurality of generally parallel flow paths extending along their length and divided from one another by interior walls, the interior walls being interrupted along the length of the multichannel tubes to form mixing sections that permit mixing of fluid from all separate flow paths through which fluid flows within each multichannel tube.

* * * * *